US011530058B2

(12) United States Patent
Jonker et al.

(10) Patent No.: US 11,530,058 B2
(45) Date of Patent: Dec. 20, 2022

(54) SYSTEM AND METHOD FOR AUTOMATICALLY CLOSING BOXES WITH CARDBOARD LIDS

(71) Applicant: Sparck Technologies B.V., Drachten (NL)

(72) Inventors: Melle Jonker, Drachten (NL); Sjoerd Van Netten, Drachten (NL)

(73) Assignee: SPARCK TECHNOLOGIES B.V., Drachten (NL)

( * ) Notice: Subject to any disclaimer, the term of this patent is extended or adjusted under 35 U.S.C. 154(b) by 34 days.

(21) Appl. No.: 17/164,228

(22) Filed: Feb. 1, 2021

(65) Prior Publication Data

US 2021/0237914 A1 Aug. 5, 2021

(30) Foreign Application Priority Data

Jan. 31, 2020 (EP) ..... 20155043

(51) Int. Cl.
*B65B 7/28* (2006.01)
*B65B 5/02* (2006.01)
(Continued)

(52) U.S. Cl.
CPC ..... *B65B 7/2871* (2013.01); *B31B 50/0044* (2017.08); *B65B 5/028* (2013.01); *B31B 2100/0024* (2017.08); *B65B 2210/04* (2013.01)

(58) Field of Classification Search
CPC .. B65B 5/028; B65B 5/04; B65B 7/28; B65B 7/01; B65B 7/2871; B65B 43/10;
(Continued)

(56) References Cited

U.S. PATENT DOCUMENTS 3,694,999 A 10/1972 Switliski et al.
3,977,306 A * 8/1976 Flynn ..... B65B 51/10 493/31
(Continued)

FOREIGN PATENT DOCUMENTS

DE 19535510 A1 3/1997
WO 2014117817 A1 8/2014
(Continued)

OTHER PUBLICATIONS

EP Search Report dated Sep. 30, 2021, for European Patent Application No. EP21154624A, 5 pages.
(Continued)

*Primary Examiner* — Thomas M Wittenschlaeger
(74) *Attorney, Agent, or Firm* — Cozen O'Connor

(57) ABSTRACT

A method for automatically closing an open packaging box with a cardboard lid, said box comprising a polygonal bottom panel defined by three or more bottom panel edges and sidewalls joined over respective crease lines to said bottom panel edges, each sidewall forming a substantially right angle with the bottom panel, said lid comprising a polygonal top panel defined by three or more top panel edges and corresponding to the bottom panel of the box to be closed and flaps joined over respective crease lines to said top panel edges and adapted for being folded onto a corresponding one of said sidewalls, the method comprising a step of folding each flap along the respective crease line partially towards a position, in which the flap forms a substantially right angle with said top panel and placing the lid above said box such that the top panel and the bottom panel are substantially aligned and such that, seen onto each sidewall, each flap overlaps one of the sidewalls, a step of releasing the lid allowing it to be guided by the partially folded flaps into a position on the box, in which the top panel and the bottom panel are aligned, and a step of folding each
(Continued)

flap onto the respective sidewall fully into said position, in which the flap forms a substantially right angle with the top panel.

15 Claims, 12 Drawing Sheets

(51) Int. Cl.
*B31B 50/00* (2017.01)
*B31B 100/00* (2017.01)

(58) Field of Classification Search
CPC ..... B65B 59/02; B65B 57/12; B65B 2210/04; B65B 61/02; B31B 50/52; B31B 50/0044; B31B 50/624; B31B 2100/0024; B31B 2120/10; B31B 2110/35; B31B 2105/0024
See application file for complete search history.

(56) References Cited

U.S. PATENT DOCUMENTS 4,160,406 A * 7/1979 Nowacki ..... B31B 50/064 493/128
4,420,924 A 12/1983 Hoyrup et al.
4,463,541 A * 8/1984 Nowacki ..... B65B 35/44 53/540
4,674,261 A * 6/1987 Sabel ..... B65B 5/028 53/242
6,048,421 A 4/2000 White
6,589,375 B2 7/2003 Knowlton et al.
9,828,128 B1 11/2017 Linnell et al.
10,836,516 B2 * 11/2020 Pettersson ..... B31B 50/16
11,242,214 B2 * 2/2022 Osterhout ..... B26D 5/32
11,286,073 B2 * 3/2022 Pettersson ..... B65B 11/004
2003/0009985 A1 1/2003 Close et al.
2008/0020916 A1 * 1/2008 Magnell ..... G01B 11/00 700/112
2011/0259946 A1 10/2011 Michaud
2013/0000252 A1 * 1/2013 Pettersson ..... B65B 5/024 348/46
2015/0019387 A1 * 1/2015 Pettersson ..... B65B 59/003 705/26.81
2015/0148210 A1 * 5/2015 Sibthorpe ..... B41J 3/407 493/324
2016/0185475 A1 * 6/2016 Pettersson ..... B65B 5/024 53/493
2016/0304252 A1 * 10/2016 Shinozaki ..... B65B 7/2878
2016/0340067 A1 * 11/2016 Winkler ..... B65B 39/02
2016/0347531 A1 * 12/2016 Becker ..... B31B 50/81
2018/0215485 A1 8/2018 Koet et al.
2018/0265228 A1 * 9/2018 Hagestedt ..... G06F 30/17
2019/0193878 A1 * 6/2019 Iwasaki ..... B25J 1/00
2019/0233142 A1 * 8/2019 Jonker ..... B31B 50/006
2021/0107246 A1 * 4/2021 Stadler ..... B65B 59/001

FOREIGN PATENT DOCUMENTS

WO 2014118629 A2 8/2014
WO 2015198250 A1 12/2015
WO 2016059218 A1 4/2016

OTHER PUBLICATIONS

"International Fibreboard Case Code," published by FEFCO and ESBO, 2007, 11th edition.

* cited by examiner

SYSTEM AND METHOD FOR AUTOMATICALLY CLOSING BOXES WITH CARDBOARD LIDS

TECHNICAL FIELD OF THE INVENTION

The invention relates to a system and a method for automatically closing boxes, in particular custom-sized boxes, with cardboard lids. The system and the method are particularly useful in systems for automatically packaging shipment sets, i.e., sets of one or more items to be shipped, in particular varying shipment sets, in which at least the number, and usually the number and the size of the items vary, in custom-sized boxes made from cardboard blanks. The invention also relates to a system and a method for automatically packaging varying shipment sets in custom-sized cardboard boxes.

TECHNICAL BACKGROUND

Mail ordering has become a widely used way of buying goods. More and more companies offer virtual department stores, in which the customers can electronically put goods in a shopping cart that later will be transferred by the respective company into a dispatch order so that in a warehouse a shipment set comprising the items ordered (and sometimes additional items such as samples, vouchers, invoices, void-fill etc.) can be assembled based on the respective dispatch order.

While assembling a shipment set in a warehouse of a specialized distributor is nowadays often done fully automated, packaging the shipment set is still a challenge, in particular when a shipment set comprises several items of different sizes and in different quantities. Often, the items to be packaged are provided automatically to a person packaging the items manually. Depending on the size and number of the items, the person selects a suitable box size.

To automate the packaging process even in cases where the items forming a shipment set vary in size and number, different systems have been proposed. One approach is shown in WO 2016/059218 A1, which discloses a system and a method for automatically packaging varying shipment sets, which system and method employ two separate packings, namely an inner packing surrounding the items to be packaged in a first direction, and an outer packing surrounding the inner packing in a second direction, said second direction being substantially perpendicular to the first direction such that the inner and the outer packing form a combined package enclosing the package items from all sides.

A different approach is shown in WO 2014/118629 A2 and WO 2014/117817 A1, which teach methods and systems that allow—within the boundaries imposed by the material used—creating a fully custom-sized box, i.e. a cuboid box, of which width, length and height are adapted to the respective content of the box.

Such systems create boxes by first obtaining information on the outer dimensions length, width and height of the shipment set to be packaged and calculating based on this information the layout of a custom-sized cardboard blank (sometimes called template or piano) comprising different so called panels, which are delimited from each other by crease lines or indentations and incisions allowing the panels to be folded in order to create the box wanted. A piece of cardboard supplied from a roll of cardboard or a stack of zig-zag cardboard is then cut-off, indented and incised (not necessary in this order) to form the blank. Depending on the specific way the system works, a box with or without an attached lid may then be formed automatically by gripping and folding the blank.

The "International Fibreboard Case Code" published by FEFCO and ESBO, 2007, 11th edition, discloses under item 0300 a box (hereinafter referred to as "type 0300" box), which is very stable and yet very easy to manufacture as the layout of the corresponding blank, from which the box is folded, is rather simple. Each box comprises a rectangular bottom panel having four edges, a first and a second rectangular end panel, each joined over a crease line to opposite edges of said bottom panel, a first and a second rectangular side panel, each joined over a crease line to opposite edges of said bottom panel, two first and two second rectangular corner panels, the first corner panels joined over respective crease lines to opposite edges of the first end panel, and the second corner panels joined over respective crease lines to opposite edges of the second end panel. As the blank typically is moved in a transport direction through a system for automatically forming custom-sized boxes, the first end panel is also called front end panel and the respective first corner panels attached to it are called front corner panels, as these panels form the front of a blank moving through the system, while the second end panel is called for the corresponding reason the rear end panel, and the second corner panels attached to it are called rear corner panels. In the erected state, the two end panels and the two side panels form the sidewalls of the box.

It should be noted that due to the thickness of the cardboard, the so-called crease lines are not thin lines as for folding paper, but are rather "crease grooves". However, following the terminology common in the art, the term crease line is used herein.

It should be also noted that in case of rectangular bottom panels, the term "width of the bottom panel" as used herein refers to the extension of a respective bottom panel in the direction of the width of the cardboard supplied for making the box, and "length of the bottom panel" refers to extension in the direction of the length of the cardboard supplied, which is also the direction, in which the cardboard is transported into and inside a system for creating custom-sized boxes. Seen in this transport direction, the end panels of the box are in front and behind the bottom panel, while the side panels of the box are to the left and the right of said bottom panel. The term "outer dimensions" refers to the dimensions of the panels on the outside of the erected box.

Boxes like the type 0300 boxes can be closed for example with lids having the same structure as the boxes, i.e. lids with corner panels, such as a "type 0300" lids shown under item 0300 in said FEFCO/ESBO publication or with lids having an even simpler blank layout such as the lids shown under item 0302 in said FEFCO/ESBO publication (so-called "type 0302" lids). In the layout of a type 0302 lid, the corner panels are cut away, so that the lid comprises just a rectangular top panel having four edges, and four rectangular flaps, each flap joined over a crease line to one edge of the top panel and each flap adapted for being folded onto a respective sidewall of a box panel, where it is fixed for example by glue or an adhesive tape. If the boxes are made from cardboard, the lids may be created from the same type of cardboard as the boxes or from a different type.

Known systems for creating custom-sized open packaging boxes and corresponding separate closing lids from cardboard being continuously supplied to the systems in particular from stacks of zig-zag folded cardboard, can be set up to produce type 0300 boxes and corresponding lids or combinations of such boxes with, e.g., type 0302 lids by first cutting out and creasing a custom-sized blank, from which a box is folded automatically around the shipment set to be packaged after placing the shipment set consisting of one or more of item(s) on the blank. Such systems comprise structure for cutting (which may also include die cutting. i.e. punching out certain parts), like rotating or reciprocating knifes, lasers, die cutters etc., structure for creasing, like crease rollers or moving stamps, structure for folding the cardboard, like moveable grippers and flaps, and structure for attaching the respective panels to each other, like a glue unit for applying hot melt glue to one or both of two overlapping panels. Upon erecting a box, the system would first fold the corner panels upwards, then the end panels upwards and thus the corner panels, which are joined to the end panels, inwards, and finally the side panels upwards.

While the known systems and methods for automating the packaging process work well for a number of applications, and in particular the system disclosed in WO 2014/117817 A1 has proven to allow packaging items varying in size and number fully automatically, it has turned out that there is still room for optimization of the packaging process.

A particular challenge is automatically closing an open box, sometimes called "tray box", i.e., a box like the type 0300 box, which has no attached lid, with a separate cardboard lid such as the type 0302 or type 0300 lid, and various systems and methods using different approaches have been proposed to improve placing and fixing lids on boxes. For example, US 2003/0009985 A1 discloses a system that takes a flat cardboard blank, which has been pre-cut and pre-creased to define a type 0302 lid, from a stack of such blanks, places it on an open box and folds the flaps onto the sidewalls of the box. U.S. Pat. Nos. 4,420,924 and 3,694,999 disclose methods for placing pre-assembled lids like type 0300 lids on corresponding boxes.

U.S. Pat. No. 6,598,375 B2 discloses a system for automatically placing lids on boxes that are almost completely filled with items having the shape of the boxes and thus providing sufficient stability for pressing the flaps of the lid against the sidewalls of the box. However, when shipment sets of varying items are packaged, the items often do not fully fill out the respective box and the sidewalls of the box can easily bend inwards when pressure is applied to the outside of a respective sidewall when the corresponding flap of a lid or an adhesive tape is pressed against the sidewall for gluing the flap to the sidewall respectively for joining the sidewall with the flap via the adhesive tape, which leads to little or no adhesion between the flap or the tape and the sidewall. While in the regions of the corners of adjacent sidewalls the boxes typically have sufficient stability, the aforementioned problem increases as the box size increases, since the regions become more flexible. This problem is particularly relevant in systems for automatically packaging varying shipment sets in custom-sized boxes. In such systems, the sizes of the boxes can vary to a great extend.

To at least partially solve the problem, a system has been proposed in U.S. Pat. No. 6,048,421 for closing open boxes with type 0302 lids, which employs L-shaped levers cooperating with flap-guiding elements. At the free end of each L-shaped lever, an elongated bar is attached that is adapted to run parallel to a crease line delimiting a flap from the top panel of a lid. In use, after placing a flat pre-cut and pre-creased blank for a lid on a box to be closed, the lever and the guiding element are brought into contact with the blank such that the bar contacts the blank on the top panel close to a crease line delimiting a flap and presses the top panel slightly into the box, which creates some outward directed pressure on the sidewall of the box, which prevents a sidewall from simply bending inwards when the respective flap is folded by the guide element onto the sidewall. However, in the proposed system the levers are mounted on a fixed frame and boxes having a flat lid blank positioned on them are moved into the fixed frame, in which the levers and the guiding elements are mounted on the same holding device, such that the proposed system cannot be used for custom-sized boxes and respective lids. Even if the holding structure would be made adjustable to different lid sizes, the levers and the guiding elements would be moved together jointly, limiting the adjustability of the system. The elongated bar also means that there is always a minimum distance between two parallel sidewalls of a box adjacent to and spaced apart by the sidewall against which the top panel is pressed by the bar, as otherwise the bar would damage said adjacent sidewalls.

Another problem that is particularly relevant in systems for automatically packaging varying shipment sets in custom-sized cardboard boxes and closing the boxes with a respective custom-sized cardboard lid is that due to the inherent properties of the material and the way it is handled in systems custom-sizing boxes and lids at high speed, the boxes and the lids are always created with certain tolerances and slight deviations, which often lead to problems with aligning a lid with a box for placing the lid on the box and folding the flaps onto the sidewalls. For example, if both, the front and the rear panel of a 250 mm high box have a deviation from the perfectly erected state (90° with respect to the bottom panel) of just one degree outward, there will be a difference of almost 9 mm between the length of a bottom panel and the length of the opening to be closed with a respective lid, which can make it extremely difficult to automatically attach a pre-folded lid onto such box even though the material is deformable to a certain extent.

DISCLOSURE OF THE INVENTION

One object of the invention is to provide a method and a system for automatically closing an open packaging box with a cardboard lid, which method and system shall be particularly useful for custom-sized cardboard boxes and which improve the aforementioned known methods and systems in at least one aspect.

These and other objects are achieved by a method according to claim 1 or claim 2 respectively a system according to claim 9 or claim 10. Independent claims 13, 14 and 15 relate to a system and a method for automatically packaging varying shipment sets in custom-sized cardboard boxes. The respective dependent claims relate to advantageous embodiments of the respective independent claims.

One basic concept of the invention is to use the partially folded flaps of the lid as guiding means for aligning the lid and the box. This can be achieved in multiple ways, for example by releasing the lid above the box and letting it drop onto it through gravity. Typically, elastic suction cups are used for handling the lid, which retract when vacuum is applied and which expand returning to their original shape when no vacuum is applied, which effect may be used to urge (push) the lid towards the box while giving it, even if still in contact with the suction cups, a sufficient degree of freedom of movement to allow the intended alignment. To increase the pushing effect of the elastic suction cups, in one embodiment an overpressure can be created in them for example by supplying compressed air to them. The air may assist the expansion of the suction cups and may also be blown onto the lid (either through the suction cups or via separate nozzles to give the lid an extra push toward the box.

While typically the boxes and lids in the folded state will be substantially cuboid, the invention is not limited to such boxes and may advantageously be as well used with boxes and lids having any type of polygonal bottom panels and respective top panels, i.e., triangular, quadrangular, pentagonal, hexagonal etc. bottom and top panels.

Further details and advantages of the invention will become apparent from the following detailed description of embodiments in conjunction with the drawing, which comprises 19 drawing figures.

DESCRIPTION OF PREFERRED EMBODIMENTS

Figure 1:
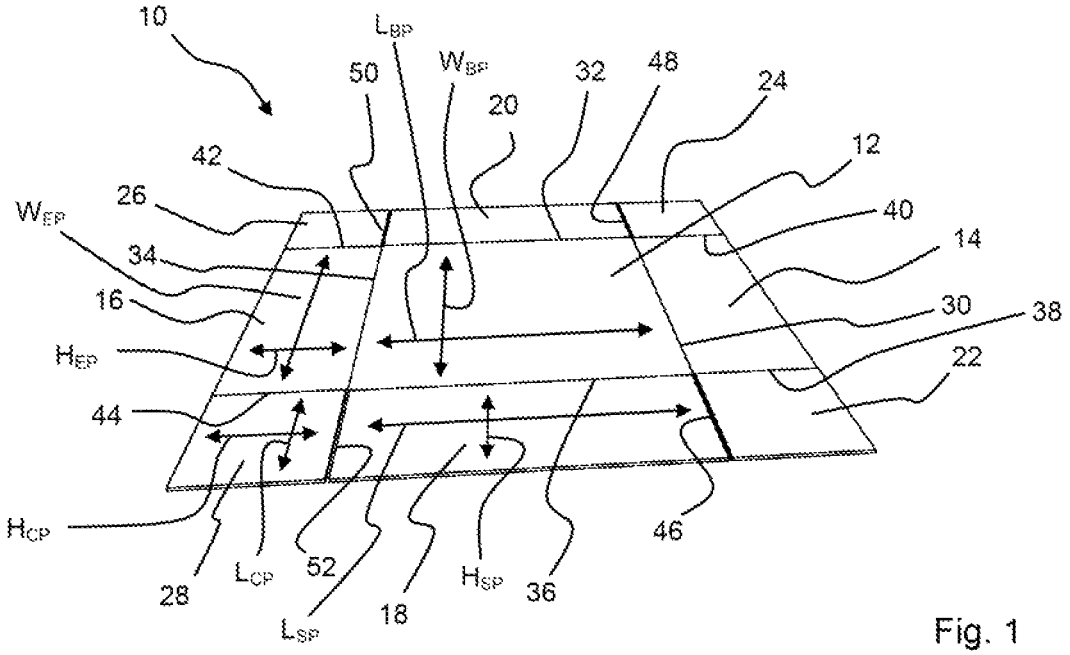
FIG. 1 is a perspective view of a cardboard blank for folding an open box.
Figure 2:
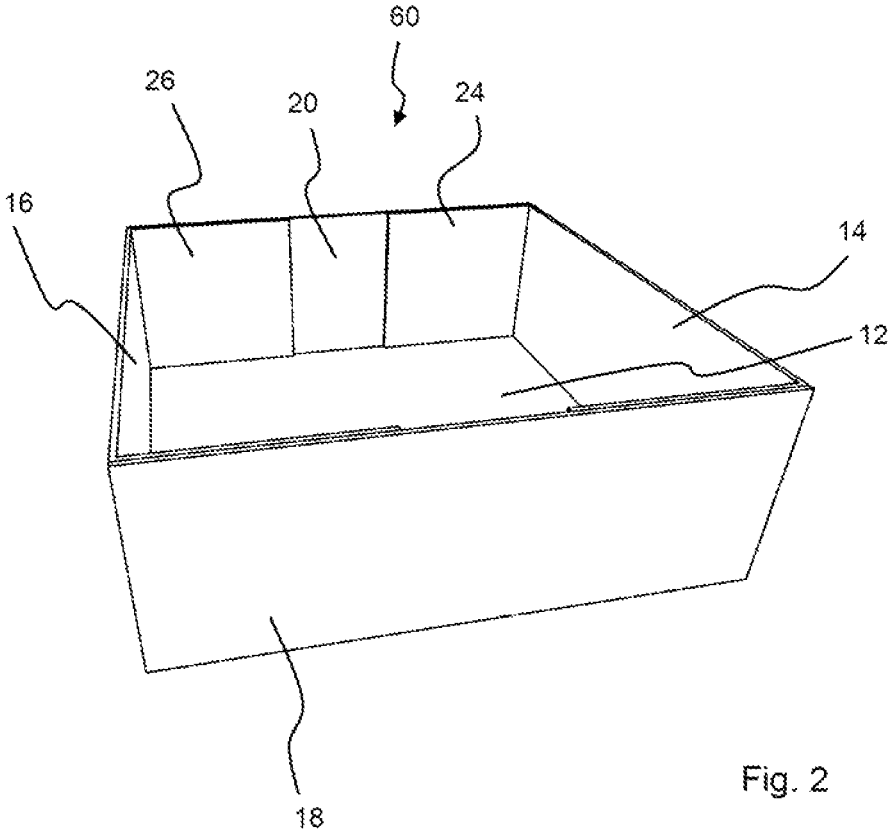
FIG. 2 is a perspective view of a box folded from the blank shown in FIG. 1.

FIG. 1 shows a blank 10 for a type 0300 box, having a bottom panel 12, a first end panel 14, a second end panel 16, a first side panel 18, a second side panel 20, two first corner panels 22 and 24 joined to opposite edges of the first end panel 14 and two second corner panels 26 and 28 joined to opposite edges of the second end panel 16. The panels are delimited against each other via eight crease lines 30-44 respectively four slots 46, 48, 50 and 52. The crease lines 38 and 44 are with respect to the crease line 36 slightly shifted, namely to an amount corresponding to the thickness of the cardboard towards the first end panel 14 respectively the second end panel 16. Likewise, the crease lines 40 and 42 are shifted in an amount corresponding to the thickness of the cardboard towards the first end panel 14 respectively towards the second end panel 16 with respect to the crease line 48. Thus, the width $W_{EP}$ of the end panels 14 and 16 is slightly less than the width $W_{BP}$ of the bottom panel 12. This allows that in the erected state as shown in FIG. 2, the corner panels 22 and 28 run perfectly parallel to the side panel 18 and the corner panels 24 and 26 run parallel to the side panel 20.

Shifting the crease lines 38 and 44 with respect to the crease line 36, and shifting the crease lines 40 and 42 with respect to the crease line 32 also leads to the fact that the length $L_{CP}$ of the corner panels is to the amount of shifting greater than the height $H_{SP}$ of the side panels.

The slots 46, 48, 50 and 52 are also dimensioned to take into account the thickness of the cardboard: the height $H_{CP}$ of the corner panels has to be decreased by the thickness of the cardboard as in the erected state these corner panels abut against the bottom panel while the top side of the corner panels shall, in this type of box, be level with the top end of the end panels. The height $H_{EP}$ of the end panels 14 and 16 corresponds to the height $H_{SP}$ of the side panels 18, 20, which in this type of box defines the maximum height of the box. However, the invention is not limited to this type of boxes, but can for example also be used with boxes such as the ones disclosed in WO 2019 081773 A1 or other types.

Due to the inherent properties of the material, the slots are typically not made such that only the height $H_{CP}$ of the cornel panels is shortened, but also the length $L_{SP}$ of the side panels, which facilitates erecting the box and ensures that the side panels do not extend beyond the end panels in the erected state. Hence, the length $L_{SP}$ of the side panels 18, 20 is typically a bit shorter than the length $L_{BP}$ of the bottom panel 12. As stated above, the first end panel 14 is considered here to be the front end panel, that is the panel that forms the front of the blank in a processing direction, in which it is transported through a system for creating boxes, whereas the second end panel 16 forms the rear end in that direction and is accordingly called rear end panel. Likewise, the first corner panels 22 and 24 are called front corner panels, whereas the second corner panels 26 and 28 are called rear corner panels. In the erected state, the first and second end panels 14 and 16 and the side panels 18 and 20 form the sidewalls of a box. As it is—with respect to closing the box with a lid—in most cases irrelevant, which panel forms which sidewall, the end panels and the side panels will later on simply be addressed as sidewalls of the box.

Figure 3:
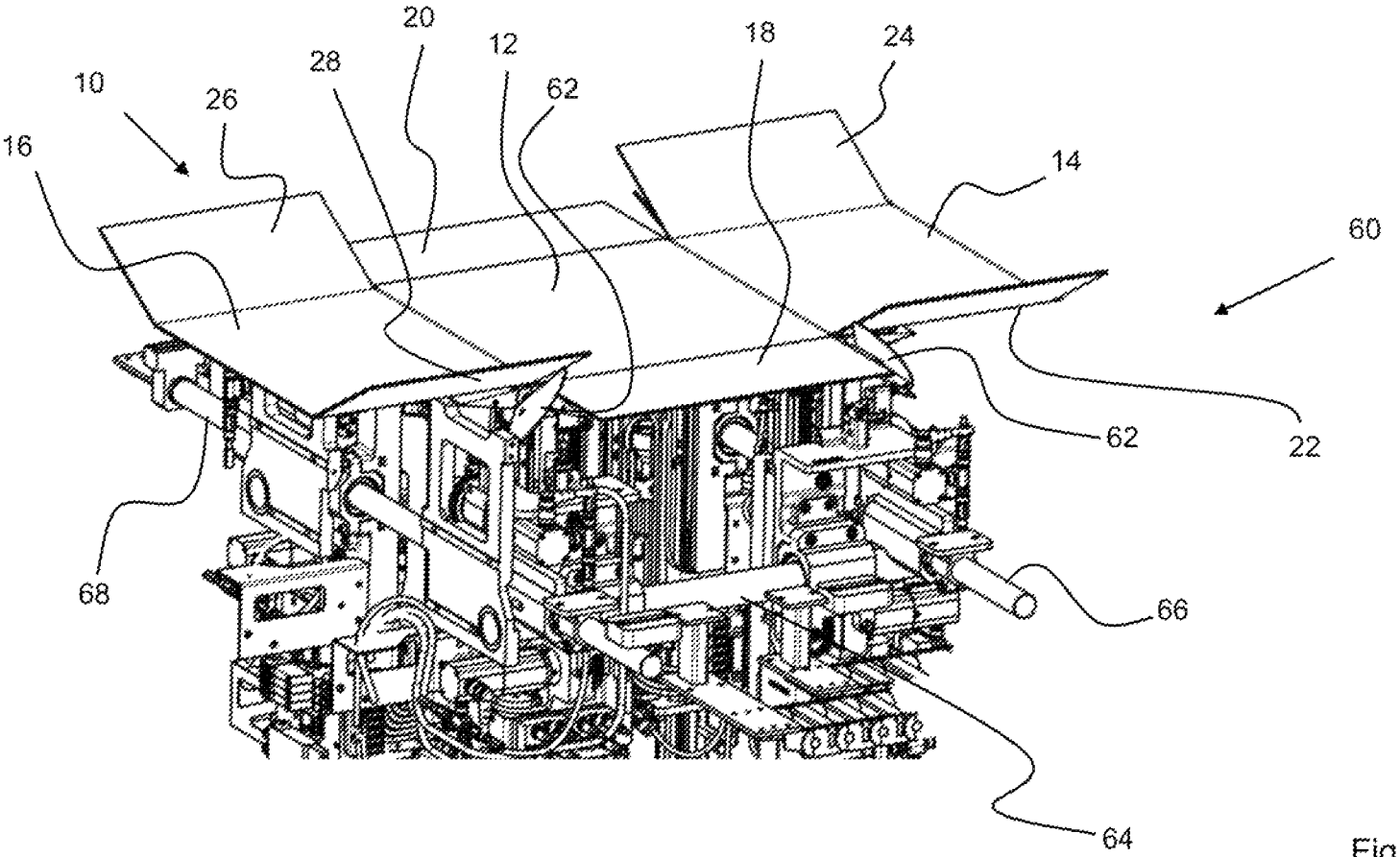
FIG. 3 shows some parts of a folding station for folding cardboard blanks.

FIG. 3 shows schematically some parts of a folding station 60 according to the prior art for folding cardboard blanks like the blank 10 shown as one example in FIG. 3 to form packaging boxes. The blank 10 has a slightly different layout than the blank shown in FIGS. 1 and 2 (the height of the end panels 14 and 16 is greater than the height of the side panels 18 and 20), but both and other layouts may equally be treated according to the invention.

The folding station 60 shown comprises four folding units, each comprising a corner panel folding element 62, of which in the shown situation, in which a cardboard blank 10 has been placed on the folding station and the corner panel folding elements 62 have started to push the corner panels 22, 24, 26 and 28 upwards, only two are visible.

The folding units are slidably mounted on rods 64, 66 and 68 in order to be moveable in a plane parallel to the plane of the cardboard blank 10, as the cardboard blanks to be folded may in this embodiment differ in size and hence the positions of the panels of the cardboard blank to be folded by the folding station 60 may vary from blank to blank. The shown folding station 60 is of exemplary nature to facilitate understanding the folding process.

The folding station 60 forms part of an automatic packaging system, in which custom sized boxes and corresponding lids can be created from cardboard fed into the system usually from stacks of zig-zag folded cardboard and in which items to be shipped are automatically packaged in the boxes formed. Such system is disclosed for example in WO 2014/117817 A1, the contents of which are incorporated herein by reference. Such automatic packaging system comprises a blank forming apparatus, in which the cardboard is cut and creased to form a custom sized blank, which then can be folded automatically. The system also comprises one or more glue application units (not shown in these schematic drawings) for applying glue on at least one of the panels of the blank 10 that are to be glued together. Such glue application unit may be adapted to apply portions of hot melt glue with at least two different surface-to-volume ratios, which can contribute to speeding up the whole process as the portions having a higher surface to volume ratio may cure faster and thus fix the panels provisionally, while the other portion may contain more glue and may lead, once cured, to a stronger bond. The glue application unit may also be adapted to apply portions of hot melt glue on the sidewalls of the erected box and/or on the flaps of a lid for adhering the flaps to the sidewalls. Depending on the general layout of the system, it may be more efficient to provide one or several separate glue application units for separate gluing steps.

It should be noted that the glue can in principle be any adhesive, while it will typically be hot melt glue, which is easy to handle in automated systems and cures fast. For sake of simplicity, in the following it will be assumed that the glue is hot melt glue and the process in which it hardens and binds those parts, between it is placed, together will be denoted as curing, although the invention is equally useful if other types of glue are used, that may not harden but that will stay soft even when the glue has set. Thus, the invention is not limited to systems using hot melt glue or systems using glue at all, as the flaps of a lid can be attached to the respective sidewalls for example by an adhesive tape.

A lid for closing a box may be folded using a folding station comprising similar elements as the ones described above for the box folding station. Depending on the general layout of the system, some folding elements used for folding the box may also be used for folding the flaps of a lid, while typically the closing of the box will happen in a separate station so that separate folding elements will be provided for folding the lid. However, the general mechanics of the folding elements is identical or highly similar, as will be understood by an expert in the art from the disclosure provided herein.

Figure 4:
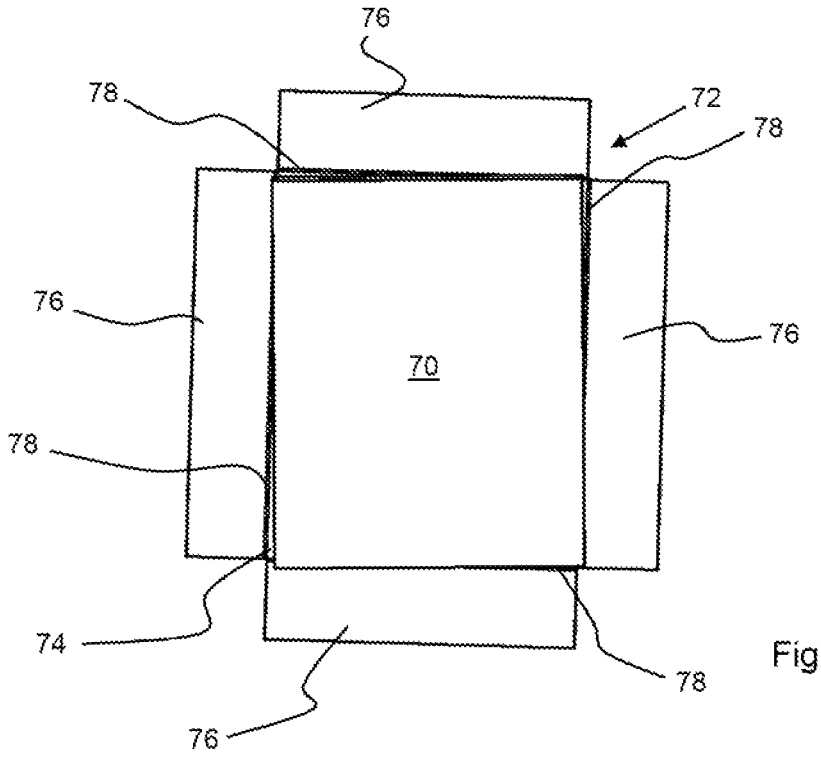
FIG. 4 is a schematic drawing to explain the problem of misalignment between the lid and the box.

FIG. 4 is a bottom view onto the bottom panel 70 of a box, on which a lid 72 having a top panel 74 and four flaps 76 has been positioned slightly misaligned, so that the crease lines 78 of the top panel 74 do not run parallel to the sidewalls respectively the edges of the bottom panel 70 of the box. Would in such situation hot melt glue, that cures rather fast, be applied on either one or both of the sidewalls and the flaps for gluing the flaps onto the sidewalls, and would the flaps be folded down onto the sidewalls, the sidewalls and/or the flaps may be deformed, the box may not be properly closed and the box may get a rather damaged appearance. Especially when the lid is already pressed onto the box, the risk is high that the lid flaps will be placed in a deformed way on the sidewalls of the box.

Surprisingly, it has turned out that by dividing the process of folding down the flaps onto the sidewalls into a first step, in which the flaps are only partially folded, and a second step, in which the flaps are fully folded onto the respective sidewalls, it becomes possible to use the flaps as guiding elements for aligning lid and box.

Figure 5:
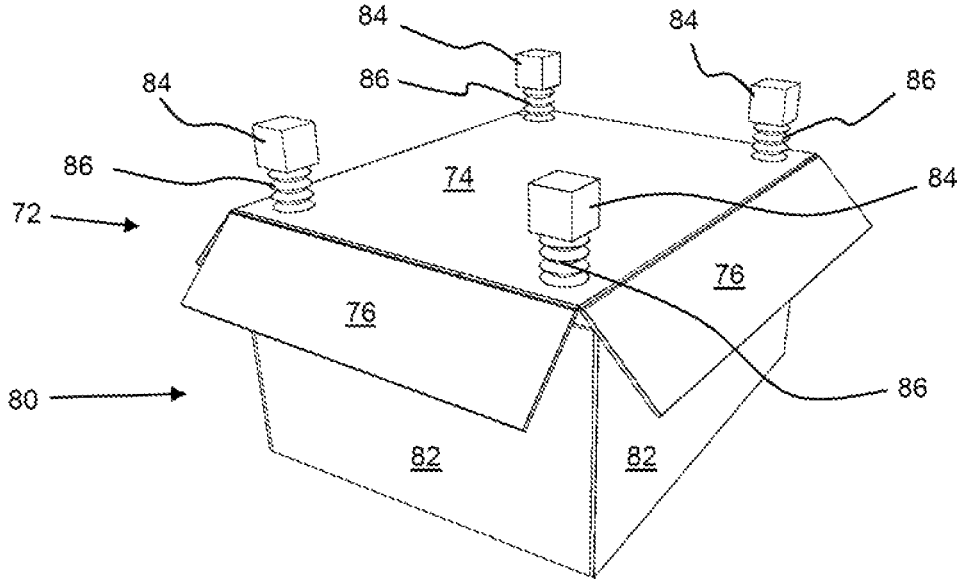
FIG. 5 is a very schematic diagram showing a lid with partially folded flaps held by suction cups above a box in a situation, in which box and lid are not properly aligned.

FIG. 5 is a schematic drawing showing a box 80 having four sidewalls 82, of which only two are visible, in a situation similar to the one shown in FIG. 4 with a lid 72 not in proper alignment with the box 80. According to the prior art, the lid 72 would simply be pressed down onto the box 80 leading to the aforementioned problem. According to the invention, the top panel 74 is held slightly above the box, for example 5 to 50 mm, preferably about 5 to 25 mm, which is in this case done by means of four lid holding units 84, each comprising an elastic suction cup 86 and connected to means (not shown) like a vacuum pump for applying a vacuum to the elastic suction cups, so that the lid, or to be precise, the top panel 74 is firmly held by the suction cups. The height, at which the top panel has to be held above the box depends obviously on the height of the flaps, as the idea is to have—seen onto each sidewall—an overlap between the partially folded down flaps and the sidewalls to use the flaps as guiding elements.

As depicted in FIG. 5, the flaps 76 (and also the two other flaps) have been partially folded down from the top panel 74 to form an angle of about 120°-150°, preferably approximately 135° with the top panel 74 of the lid 72. This folding operation can be done prior to placing the lid above the box or after it has been placed above the box or even during placing the lid above the box. Typically, the lid is taken from a cutting and creasing station for forming a corresponding cardboard blank and transported using the suction cups to a position like the one shown in FIG. 5, in which it is at least to a great extend aligned with the box to be closed by the lid, and in which, seen onto each sidewall, each flap overlaps one of the sidewalls. When the lid is released in a situation as shown in FIG. 5, lid will fall down under the influence of gravity onto the box or, as will be explained later, is pushed onto the box by the expanding suction cups. In either case, the partially folded flaps of the lid will function as guiding elements, ensuring proper alignment of the lid and the box. Depending on the setup of the corresponding system, the lid may absolutely move to align with the box, or the box may absolutely move to align with the lid, or both, box and lid may move.

Figure 6:
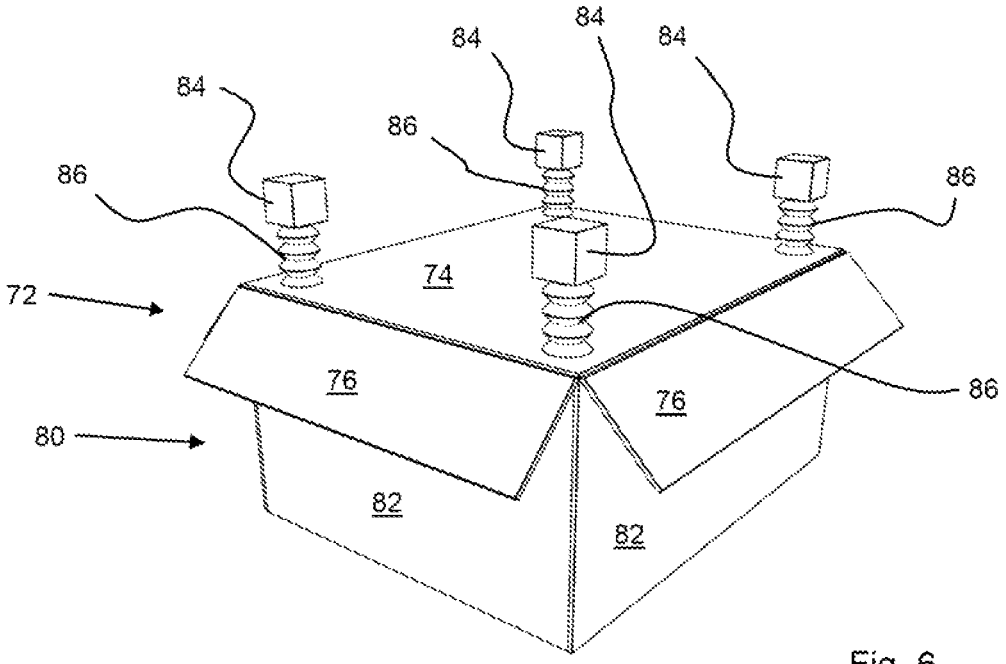
FIG. 6 shows schematically the lid and the box of FIG. 5 in a situation, when the suction cups have been released, allowing the flaps of the lid to function as guiding elements for aligning lid and box.

FIG. 6 shows the situation, when the vacuum applied to the suction cups 86 has been released. The elastic suction cups 86 expand to their original position and facilitate movement of the lid 72 towards the box 80, while their flexibility allows the lid to move sufficiently to align with the box as the partially folded flaps slide along the upper edges of the respective sidewalls of the box (in case there is misalignment). Of course, as will be understood by an expert in the art from the disclosure herein, if the box is supported in a manner that allows it to move easily, also the box may move to align with the lid once the lid comes down onto the box and the partially folded flaps function as guide elements. While it is possible to allow the lid to fall down onto the box simply under the influence of gravity, providing the suction cups such that when no vacuum is applied they expand and press the lid towards the box advantageously ensures that the lid and the box stay in alignment when in a next step the flaps are fully folded onto the sidewalls. In other words, in one embodiment the suction cups may be designed such that when they expand after a vacuum applied to them has been turned off, they slightly press against the lid and stay in contact with it, while in another embodiment it may also be foreseen that the suction cups loose contact with the top panel as it just drops onto the box due to gravity. The flaps 76 visible in FIG. 6 and of course the other two flaps can now be folded down fully onto the respective sidewalls 82, onto which glue may have been applied as described above.

As also described above, glue may also or alternatively have been applied to the flaps. During the expansion of the suction cups, the lid flap folding elements may be moved further down to maintain the angle at which the lid flaps are partially folded. This can prevent that the flaps, due to the memory effect of the cardboard, move back towards the plane of the top panel, which may reduce or even eliminate the aligning effect of the side flaps.

Figure 7:
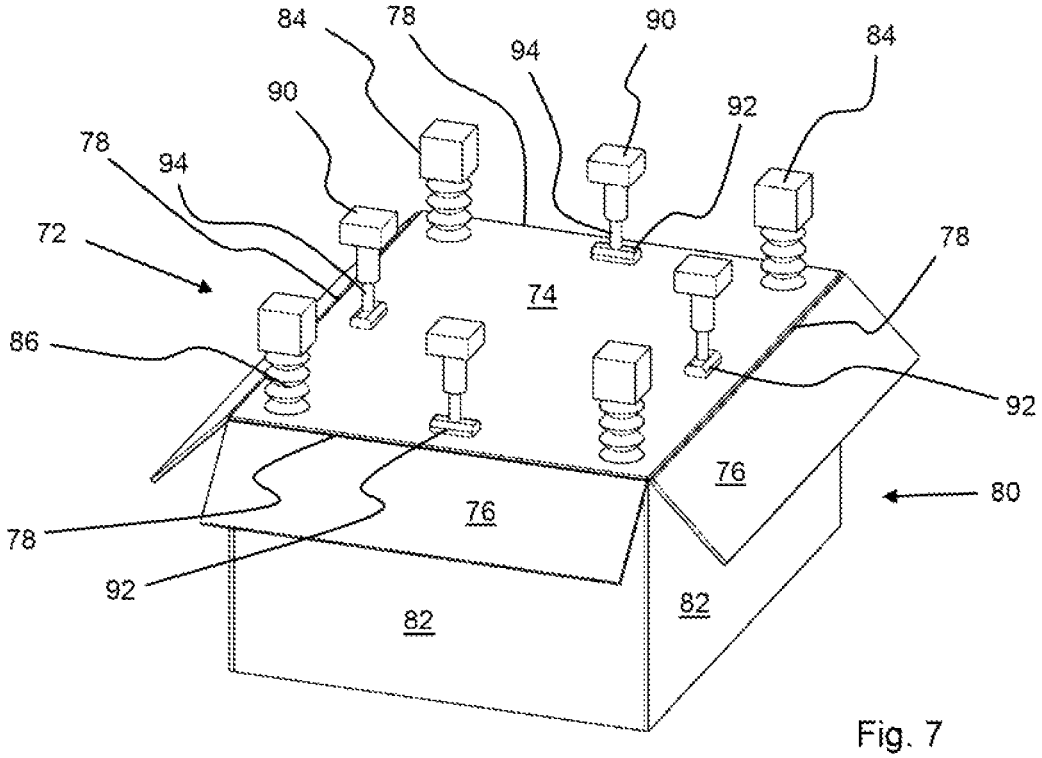
FIG. 7 is a very schematic drawing of a lid placing station showing schematically only some elements of such station, namely suction cups for holding a lid and active pushing elements.
Figure 8:
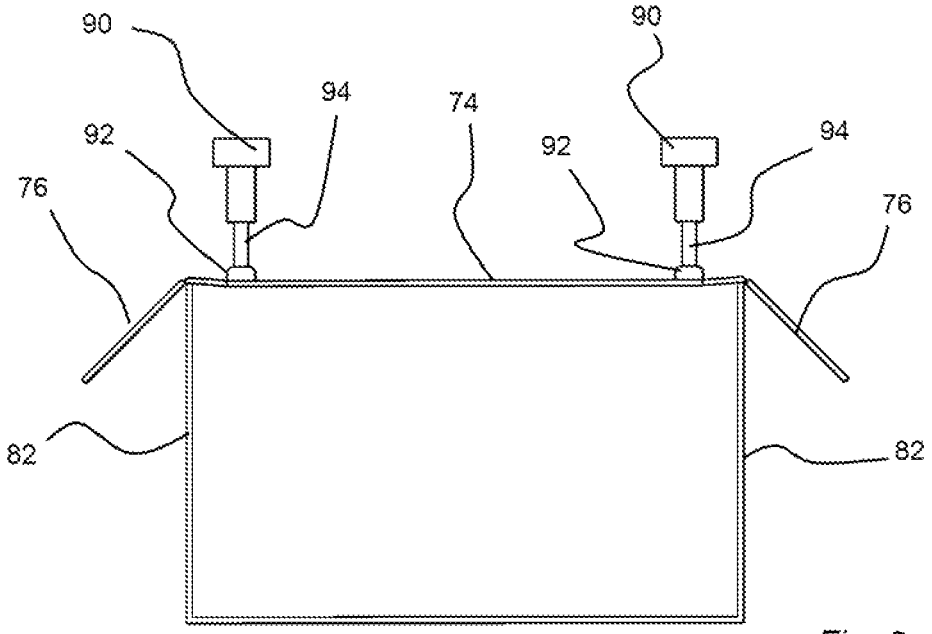
FIG. 8 is a schematic sectional view drawing to explain the functioning of the pushing elements.
Figure 9:
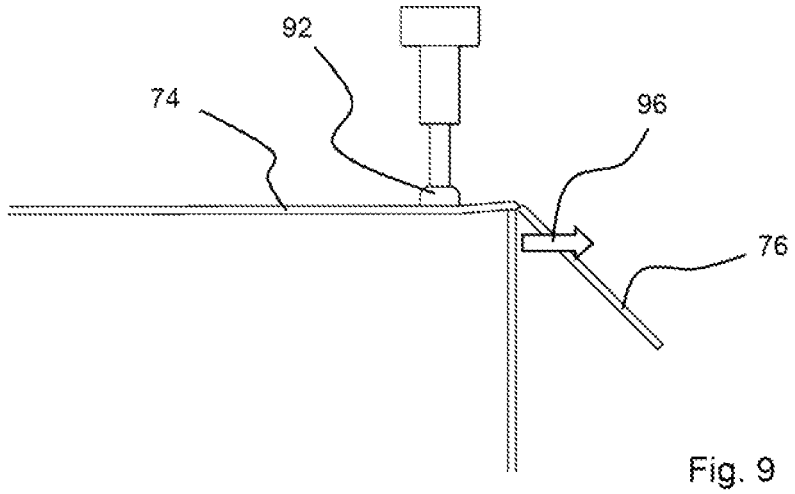
FIG. 9 is an enlarged view of a part of FIG. 8.

FIG. 7 shows very schematically further elements for closing a box 80 with a lid 72, namely pushing elements 90, each comprising a stamp 92 movably connected via a respective rod 94 to the pushing element (for sake of clarity, only some of these parts have been provided with reference numbers). The pushing elements can be positioned as shown in FIG. 7 such that each stamp 92 contacts the top panel 74 close to the middle of one of the crease lines 78 delimiting the top panel from the flaps. Once the lid 72 is positioned on and aligned with the box 80, the stamps 92 slightly press the lid into the box, as shown schematically in FIGS. 8 and 9, which are sectional views along a vertical plane in FIG. 7 parallel to one of the side walls 82 of the box and in which only two respectively only one pushing element is shown together with a portion of lid 72 and a portion of box 80 to facilitate understanding the principle. It should be noted that slightly pressing the lid into the box means that the stamps 92 once in contact with the top panel make a movement in the order of a few millimeters, typically in the order of once or twice the thickness of the cardboard used for the lid, which does damage the cardboard or lead to remaining deformations of the lid or the box, but which creates some outward directed forces as indicated by arrow 96. Surprisingly, it has turned out that even such slight forces create sufficient counter pressure preventing a respective sidewall from bending inwards when a respective flap is folded onto it, ensuring, if glue is used between sidewall and flap, proper bonding of the glue along the complete length of the flap, respectively, if adhesive tape is used to fix the flap to the sidewall, to ensure proper contact between the tape, the flap and the sidewall.

Figure 10A:
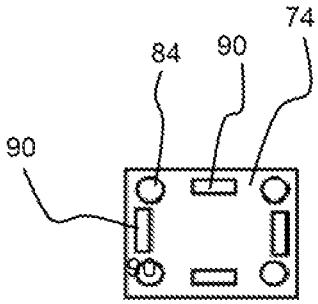
FIGS. 10A and 10B are schematic drawings showing lids of different sizes and suction cups and pushing elements differently positioned to adapt to the different sized lids.
Figure 10B:
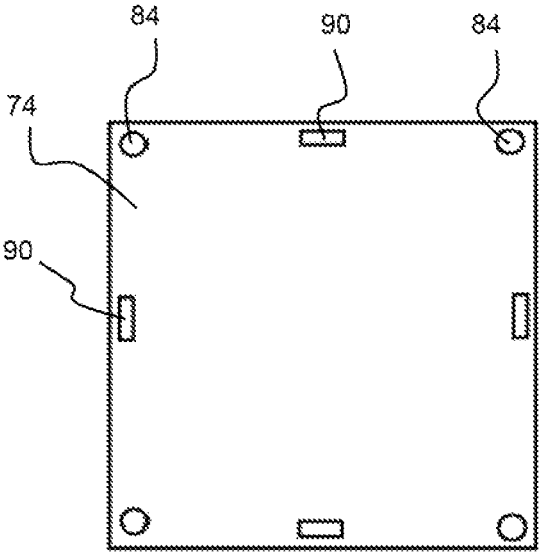

Both, the lid holding units 84 and the pushing elements 90 can advantageously be movable in a plane parallel to the plane of the top panel 74 of a lid as schematically indicated in FIG. 10, in which FIG. 10A shows very schematically the top panel 74 of a rather small lid and FIG. 10B shows the top panel 74 of a much larger lid. In each case, the lid holding units 84 and the pushing elements 90 have been moved by using well-known X-Y mechanics such that the suction elements are positioned close to the corners of the respective lid, while the pushing elements are positioned close to the middle of the crease lines delimiting the flaps 76 from the top panel 74 of the lid 72. For sake of clarity, only some of the lid holding units 84 and the pushing elements 90 have been provided with reference numbers.

Both, the lid holding units 84 and the pushing elements 90 are also movable in a direction orthogonal to the plane of the top panel 74 of a lid, either individually or jointly or in groups, i.e. the lid holding units may be attached to structure for moving them in simultaneously in said orthogonal directions towards and away from the top panel and the pushing elements may likewise be attached to structure for simultaneously moving them in that direction. A control unit comprising e.g. a microcontroller, a computer etc. may control the movement of the lid holding units and the pushing elements, and the pushing elements shown in FIGS. 7, 8 and 9 may be of pneumatic, mechanical or hydraulic type for moving the stamps 92 or other suitable structure in particular via the respective rods 94 towards and away from the top panel.

However, in another preferred embodiment, the pushing elements may have no actively movable elements such as the stamps 92 being able to be actively pushed out and drawn into the pushing elements, but may be of "passive" type, in which they are pressed onto the lid by moving the complete pushing elements as such towards the top panel, which will now be described with respect to FIGS. 11, 12 and 13.

Figure 11:
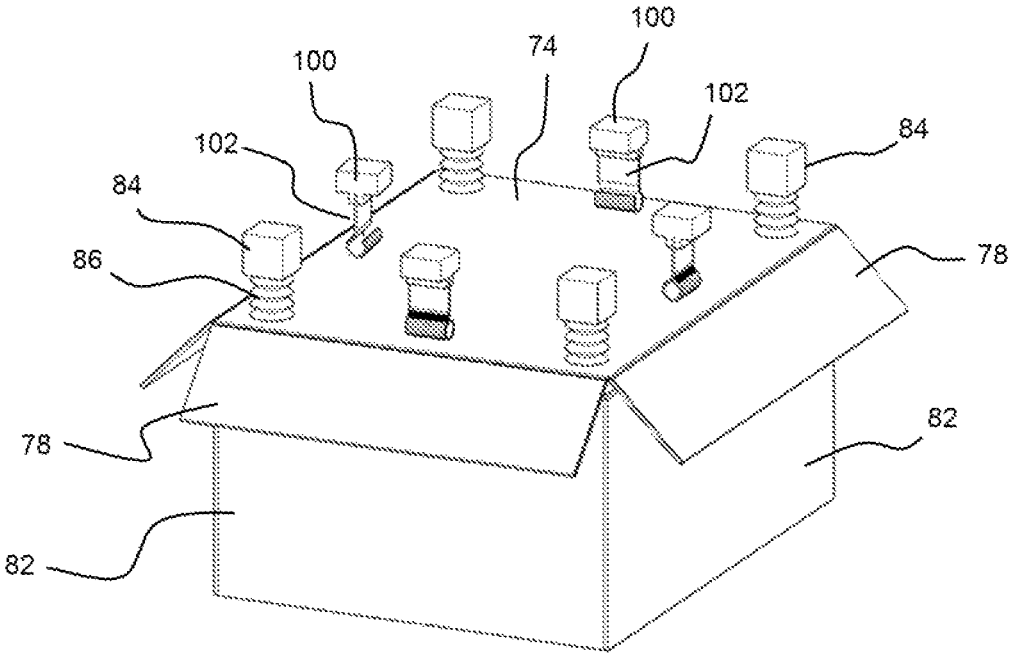
FIGS. 11 to 13 show parts of a lid placing station comprising passive pushing elements.
Figure 12:
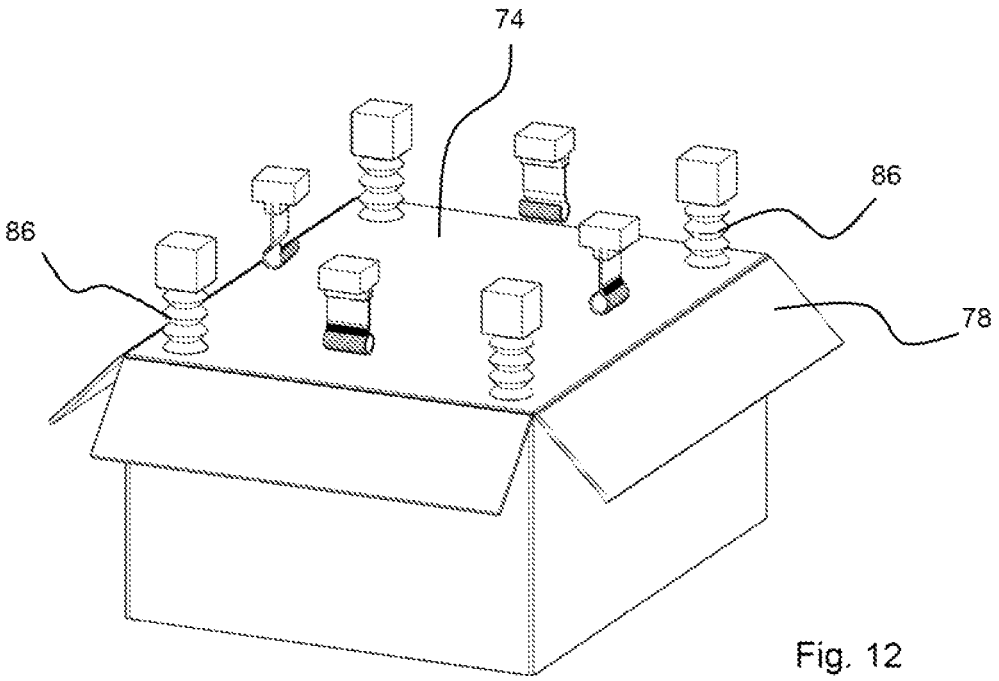
Figure 13:
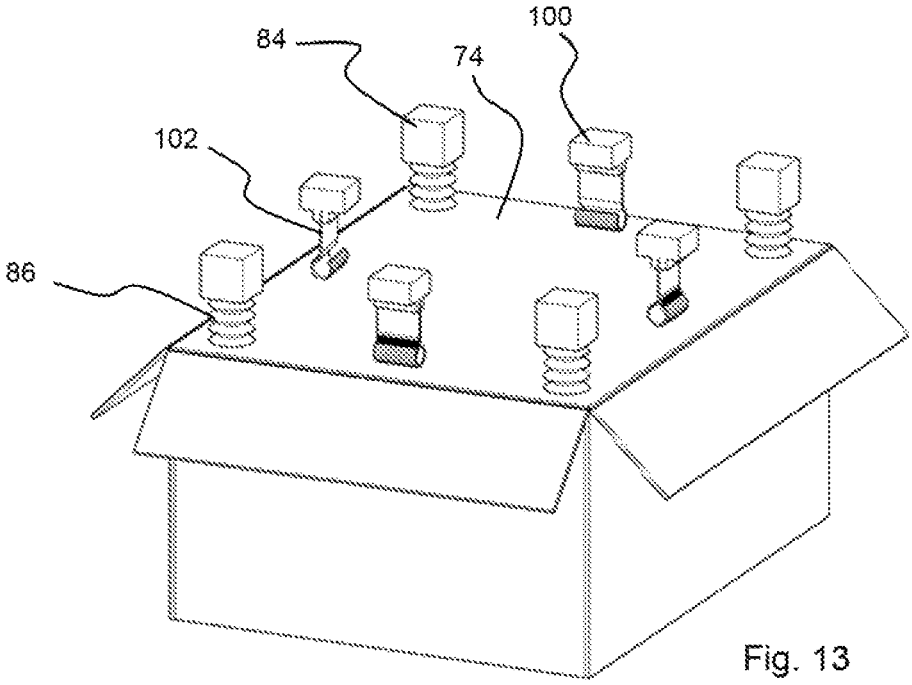

In FIGS. 11, 12 and 13 an embodiment is shown, in which a lid placing station comprises so-called passive pushing elements 100 comprising thin spring steel strips 102, each having a "question mark" shape. For sake of clarity, only some of the elements in FIGS. 11, 12 and 13 have been provided with reference numbers. Of course, instead of the spring steel strips other passive pushing elements may be used, for example helical springs.

The lid placing station also comprises lid holding units 84 with suction cups 86, that have been described above. In the situation shown in FIG. 11, the top panel 74 of a lid has been gripped by the lid holding units 84 and has been placed slightly (e.g. between 10 and 50 mm) above a box to be closed, i.e. above the upper edges of the side panels 82 of the box. As can be seen in FIG. 11, the suction cups 86 are contracted and hold the lid against the spring steel strips 102.

In the situation shown in FIG. 12, the vacuum applied to the suction cups 86 has been turned off so that the elastic suction cups 86 expand and allow that the lid is guided by the flaps 76 into a position, in which it is perfectly aligned with the box.

When the lid is aligned with the box, the structure (not shown) which holds the lid holding units 84 and the pushing elements 100, and which forms a lid application unit that is part of a lid placing station, moves further down, until the passive pushing elements 100, or to be more precise the spring steel strips 102 the lid on the box. The suction cups 86 contract again, but this time due to the pushing force of the lid application unit. FIG. 13 shows this situation.

Figure 14:
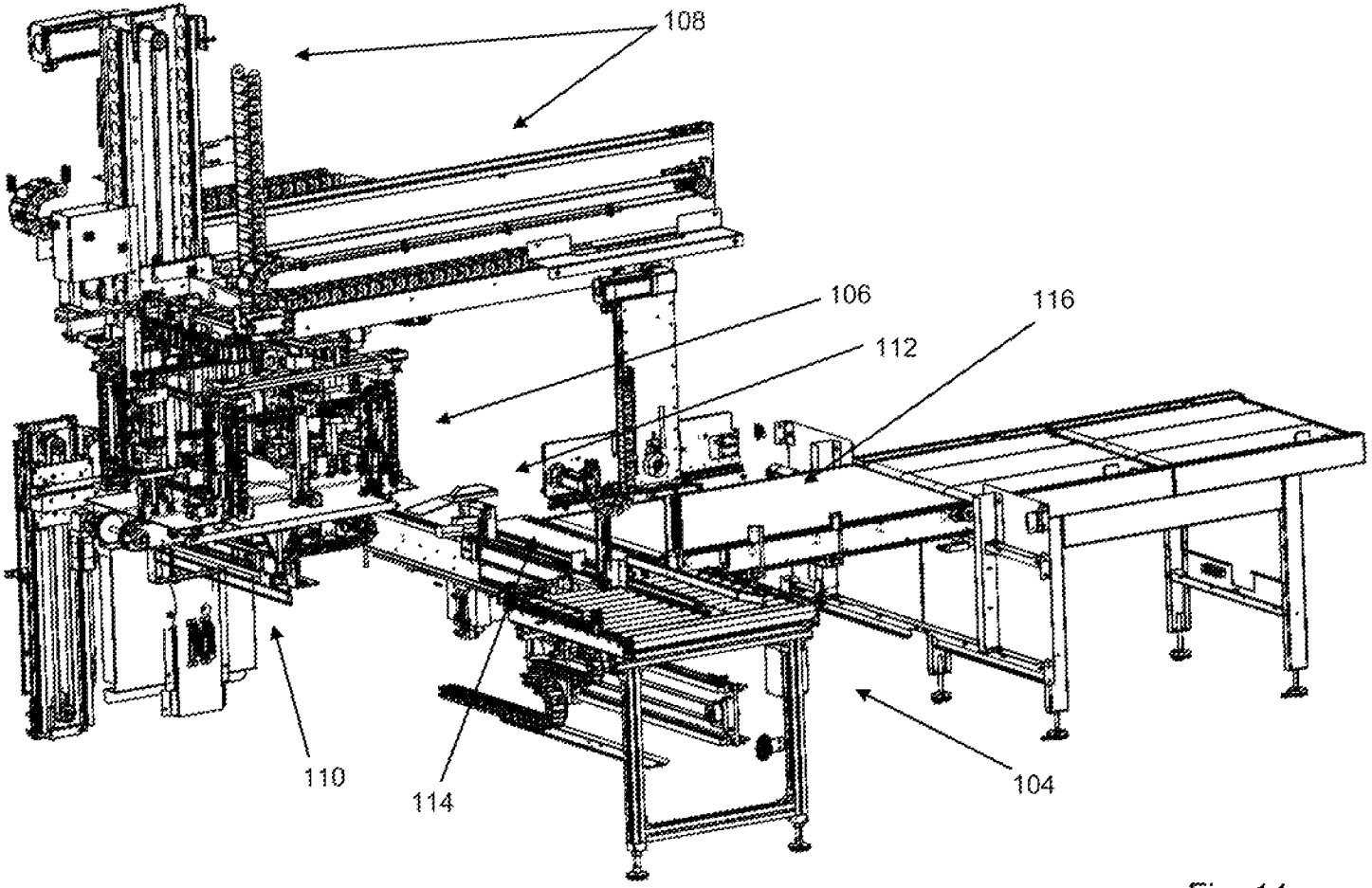
FIGS. 14 and 15 a functional part of a system adapted for placing lids on boxes from two different perspectives.

FIG. 14 shows a functional part of a system adapted for placing lids on boxes. The system comprises a box entry unit 104. A conveyor may transport the boxes to be closed to this unit. The box entry unit 104 has a centering function that allows to center the box with respect to the further treatment and in particular with respect to a lid application unit 106. The box entry unit 104 also comprises glue application units that are adjustable in width and height for applying lines of glue to the side panels of a box to be closed. A so-called finger transport moves the boxes that enter the box entry unit from this unit to a position, in which a lid is placed.

Reference number 108 denotes structure that allows to move the lid application unit 106 horizontally and vertically. Underneath the lid application unit is a lid entry unit 110, which comprises adjustable side guides and an adjustable stopper to position and center a lid and to bring it into a position to be taken over by the lid application unit.

Reference number 112 denotes a glue application unit for the lids. Only one such unit is visible, but the system in fact comprises two such units. When a lid is transported the lid application unit to a position, in which it is applied onto a box, the lid moves past the glue application units and at both side flaps of the lid lines of glue are applied. The glue station is adjustable to the width of lids of various sizes.

Reference number 114 denotes the lid application position, while reference number 116 denotes the box exit unit and position. The lid application unit brings the closed box to this position, from where it is transported out of the lid application system.

Figure 15:
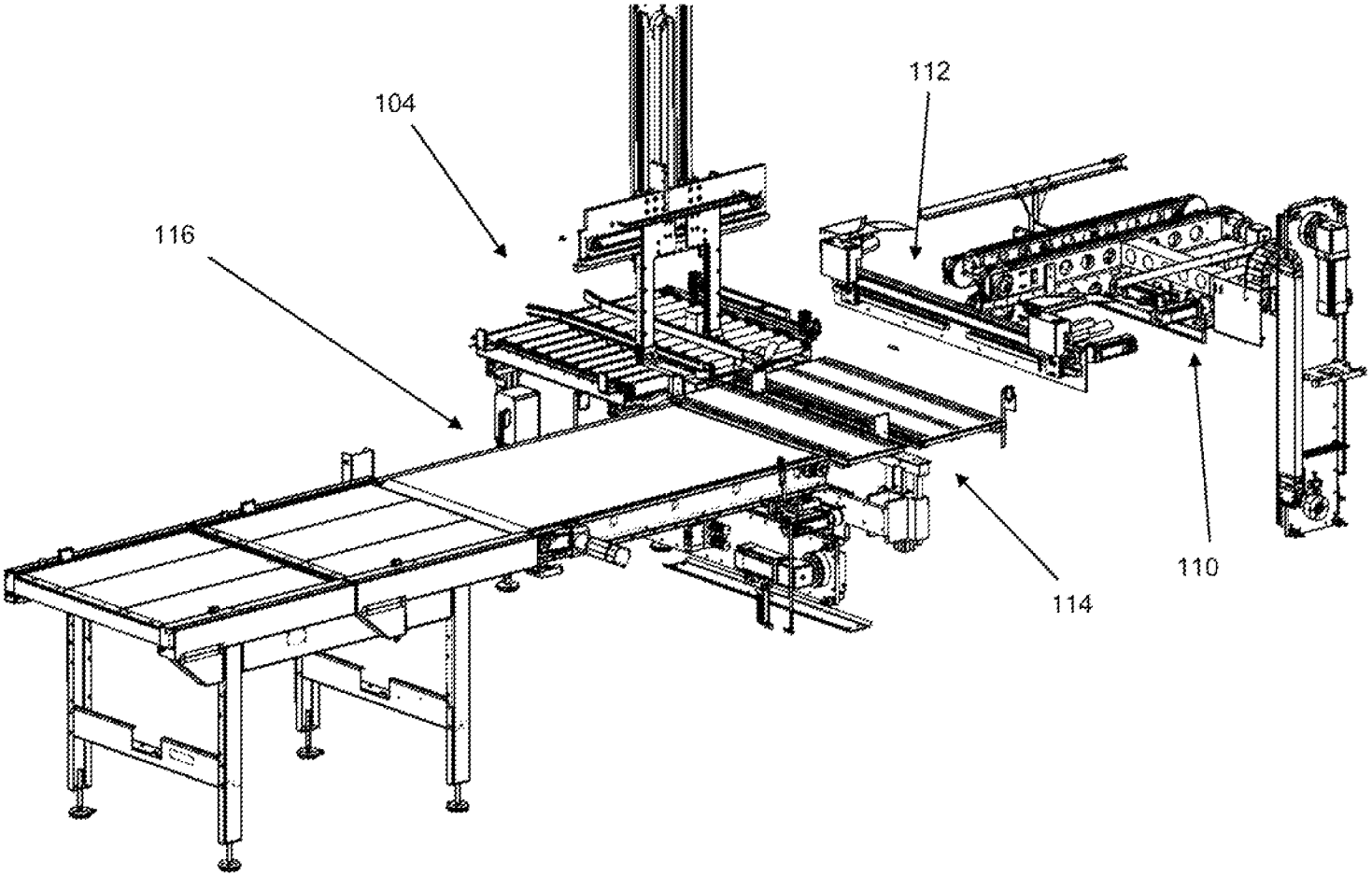

FIG. 15 shows the system of FIG. 14 from a different perspective. In this perspective, it can be seen that the lid entry unit 110 comprises transport belts and left and right guides for aligning the lid. The lid entry unit is adjustable in height in order to pick up a lid from a lower position and bring it to the height of the lid glue application unit 112. In this perspective, it is also visible that the glue station comprises two glue units. Again, reference number 114 denotes the lid application position, and transport fingers that bring the box to be closed from the box entry unit to the lid application position are visible. The fingers can move below the transport surface to return to the initial position. When both, the lid and the box, are present at respectively the lid entry unit and the box entry unit, both, the lid and the box move to the lid application position. During this transport, glue is applied to two sides of the box and to two lid side flaps, namely those flaps of the lid that are to be positioned against side walls of the box, onto which no glue has been applied. At the lid application position, the lid application unit places the lid on top of the box and folds the flaps down as described above, altogether also aligning the lid with the box.

Figure 16:
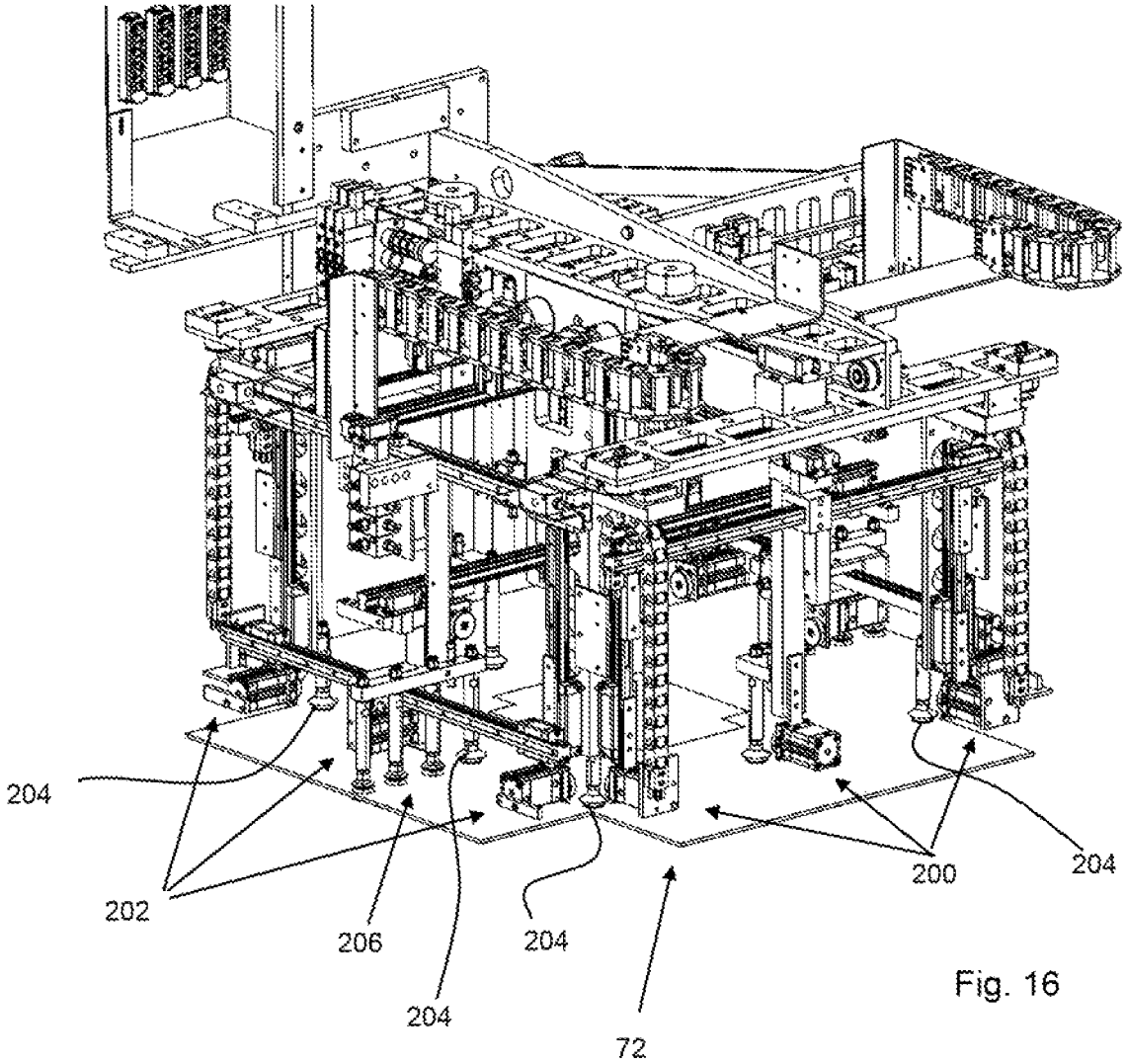
FIGS. 16 to 19 show different embodiments of systems according to the invention.

FIG. 16 is a detailed view of a lid application unit in a so-called "wide" position for handling a long and wide lid 72, of which the crease lines delimiting the flaps from the top panel are not shown. The lid application unit is fully adjustable in width and length to accommodate for any lid size between a minimum and a maximum length and a minimum and a maximum width. Reference number 200 denotes lid flap folding and pushing elements on one side of the lid 72. On the opposite side, a similar set is present. In this embodiment, the lid flap folding and pushing elements 200 are adapted for folding those flaps of a lid that shall be placed on left and right sides of a box in the sense of the description above (see in particular FIGS. 1 and 2, in which a distinction was made between the side panels 18 and 20 forming left and right side walls of a box, and the first and second end panels 14 and 16, also called front and rear end panels) that form side walls of a box. The lid flap folding and pushing elements can be moved down to fold the side flaps onto respective left and right side walls of a box and they can push inwards to press the lid flaps against the respective side walls. The level, to which they are moved down, depends on the length of the side flaps and is dynamically adjusted to this.

Likewise, reference number 202 denotes lid flap folding and pushing elements on the rear side of the box for pushing a respective rear flap of a lid. On the opposite side (the front side), a similar set is present. The lid flap folding and pushing elements can be moved down to fold the front/rear flaps of the lid and they can push inwards to press the lid flaps against the respective side walls of the box. The level, to which they are moved down, depends on the height of the lid front/rear flaps and is dynamically adjusted to this. The lid front/rear flaps may have a different height than the lid side flaps.

Reference number 204 denotes suction cups to hold the lid. In this embodiment, there are eight suction cups to hold a lid, four at each corner of the lid top panel and four in the middle of each edge of the top panel, while only some of these cups have been provided with reference numbers.

Reference number 206 denotes suction cups to hold the lid front and rear flaps. In this embodiment, there are three suction cups on each side to be able to hold short and long lid flaps. Also, in case one of the suction cups suffers from air loss, e.g. due to a crease line present at a position, where the suction cup contacts the flap, the other two may still provide sufficient holding force. Only the lid front and rear flaps are held, as this is the transport direction of the lid with a greater risk of falling down.

Figure 17:
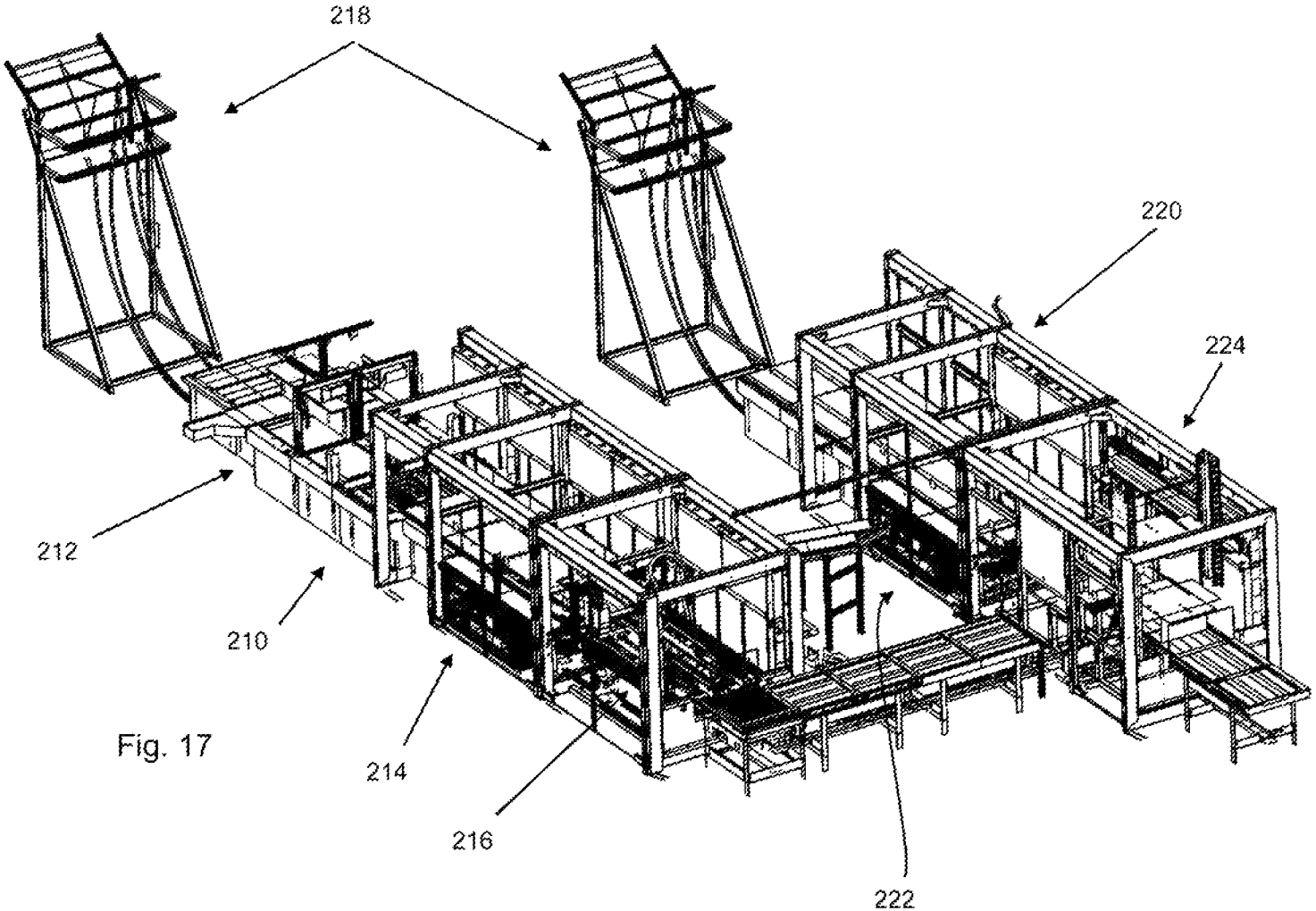

FIG. 17 is a schematic drawing of a system comprising a box creating station and a lid application station. 210 denotes a box creating station. 212 denotes an order feed unit. In this embodiment, two order feed units are provided, one at the front and one at the rear. Reference number 214 denotes a blank creating unit for cutting out a blank for a custom-sized box. Reference number 216 denotes a box folding unit. Reference number 218 denotes feed units for zig-zag folded cardboard. Reference number 220 denotes a lid forming station. Reference number 222 denotes a lid blank creation unit, in which blanks for custom-sized lids are formed. Reference number 224 denotes a lid application station.

Figure 18:
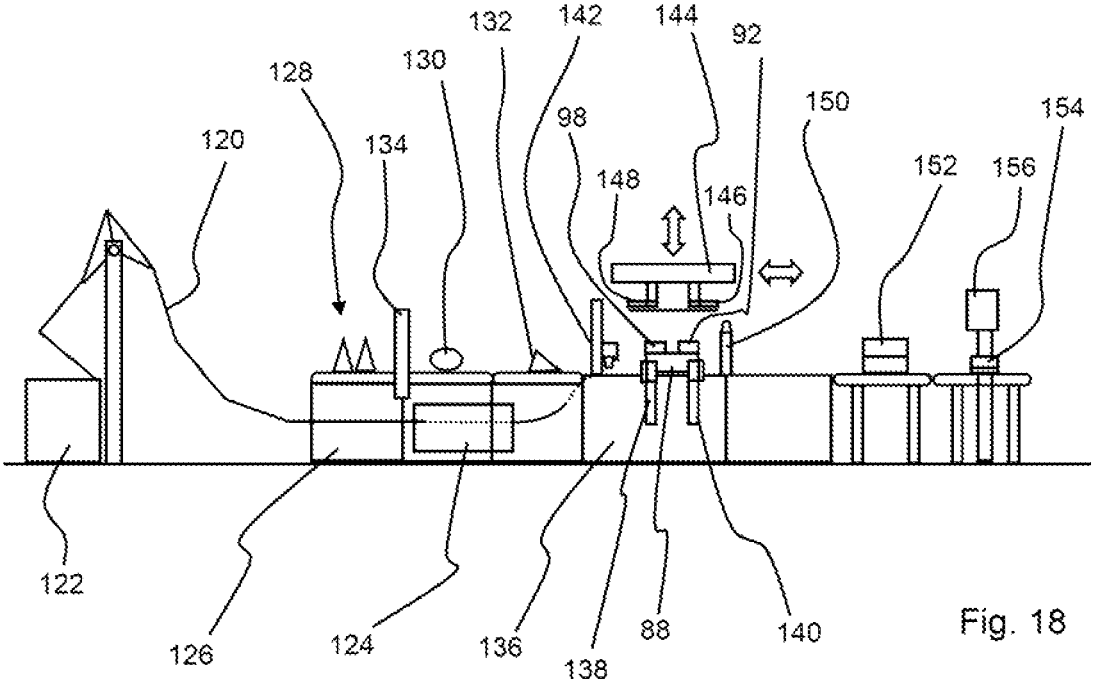

FIG. 18 is a schematic diagram showing a system according to the invention. Cardboard 120 is supplied from a stack 122 of zig-zag folded cardboard to a cutting and creasing station 124 for cutting the cardboard, punching out slots between the corner panels and the side panels and introducing crease lines to delimit the respective panels from each other and to thus produce a blank for a custom-sized box. The respective dimensions of the panels are calculated as set forth above, and the system comprises for this purpose a calculating unit, which can form part of a control unit for controlling the complete system and which may for example be integrated in a receiving unit 126, where items like the items 128, 130 and 132, which shall be packaged, are placed either automatically or manually. The items to be packaged are transported via conveyor belts through a laser scanning unit 134, which measures the outer dimensions of the items passing through the unit in order to obtain information on the desired inner dimensions length LD, width WD and height HD a box needs to have in order to receive the items or the arrangement of items as they are, i.e. without re-arranging the items. Of course, the system could also be provided with structure for arranging the items in a certain manner for example to reduce the volume needed. However, in this schematic drawing a simple and fast working embodiment is shown. The cardboard blank is transported from the cutting and creasing station 124 to a folding station 136, where the item or the items to be packaged are put on top of the bottom panel of the respective blank cut and creased in the cutting and creasing station. Respective grippers and folders like the gripping and folding units 138 and 140 fold the box around the item(s) to be packaged as described above, i.e. erect all four corner panels, of which two, namely corner panels 92 and 98, are visible in this view upwards, then fold the end panels inwards thus folding also the corner panels inwards and finally the side panels, of which side panel 88 is visible in this view, upwards.

When the respective blank is transported from the station 124 to the station 136, it passes a glue application unit 142, which applies hot melt glue to the parts of the side panels, which are to be brought into contact with the corner panels.

To close the box, in this embodiment a lid placing station 144 is provided, which as indicated by the double-sided arrows is moveable upwards and downwards, forwards and rewards in the transport direction of the items respectively the boxes. Similar to the blanks for the box, based on the calculated dimensions a blank for the lid is produced and picked up by the lid placing station 144 for example with suction grippers that can be integrated in respective folding units 146 and 148 of the lid placing station. A glue application unit 150 applies hot-melt glue to the end panels and the side panels of the lid, which is placed on top of the box that just has been erected, upon which the end panels and the side panels of the lid are folded downwards. The thus closed boxes 152, 154 are then transported via respective conveyor belts to a label printing and application unit 156, which puts a label including for example address of the recipient and postage on the boxes, which then can be picked up and further transported. The lid can be created from the same cardboard supplied as the box, in case of which the cutting and creasing station may be set up to produce not only a blank for the box, but also a blank for the lid, which may then be transported via respective conveyor belts to the lid placing station, which picks up the lid and puts it on top of the box.

Figure 19:
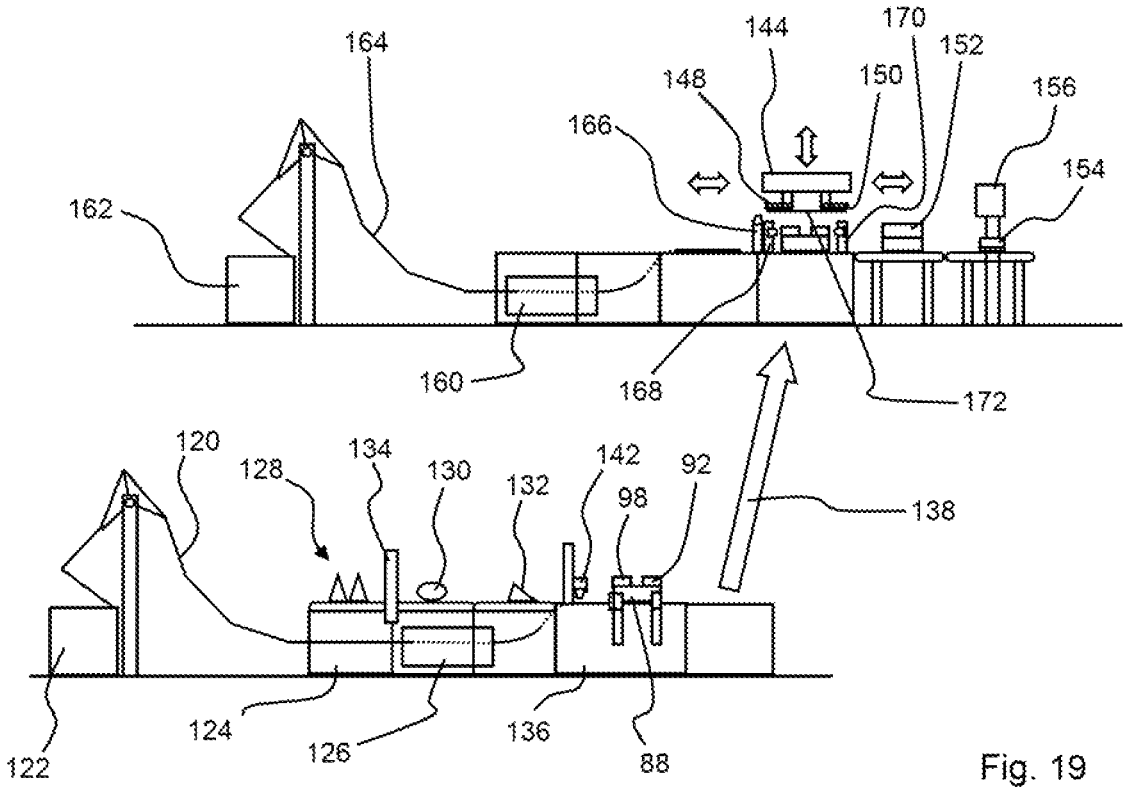

FIG. 19 schematically shows an embodiment of a system according to the invention, which comprises separate production lines for producing the boxes and the lids, which could increase the through-put of the system. As in FIG. 16, items 128, 130 132 are scanned, blanks are produced from cardboard 120 and boxes are folded around the items via respective stations 124, 126, 136 as shown in FIG. 16. However, the boxes are then transported as indicated by arrow 138 to a lid creation and placing line, in which lids are produced more or less parallel to producing the boxes. Like the box creation line, the lid production line comprises a station 160 for cutting and creasing the cardboard supplied from a stack 162 of cardboard 164, which may correspond to the cardboard used for producing the boxes or which may have different properties, in particular different widths, strengths, branding etc. It is also possible to provide the lid production line with different cardboard supplies so that depending for example on the dimensions needed for a respective lid, a cardboard can be chosen that allows to reduce the amount of waste produced upon producing the lid. As described above, it may be that the lid is cut out from the cardboard supplied in a "rotated" manner, i.e. such that seen in the transport direction of the cardboard the side panels are in front and in the rear of the top panel of the lid, whereas the end panels are to the left and the right of the top panel. In order to properly align the box and the lid, the system may comprise a box rotating unit, in which during transporting the box from the box line to the lid production and placing line the box is rotated, if necessary, by 90° in order to align the lid and the box. As is apparent from the present application, of course instead of rotating the box, if is necessary at all, the lid may be rotated by 90°.

Both production lines comprise glue application units 142, 166, 168 and 170. In this embodiment, the lid placing station 144 comprises a separate glue unit 166 for applying hot-melt glue to the side panels in the transport direction of the cardboard of the lid 172 to be placed on a box, and two glue units 168 and 170 for applying holt-melt glue to the end panels of the box where the end panels of the lid have to be attached to the box.

Within the idea of the invention, multiple variations are possible. For example, while in the shown embodiment a number of pushing elements corresponding to the number of flaps has been employed, the respective counterforce on the sidewalls ensuring that the sidewalls do not bend inwards when the flaps are folded onto them, can in particular when the boxes are rather small be created by a single pushing element having for example the shape of a spherical dome with a large radius and pressing only in the middle of the lid.

LIST OF REFERENCE NUMBERS

10 blank
12 bottom panel
14 first end panel (front end panel)
16 second end panel (rear end panel)
18 first side panel
20 second side panel
22, 24 first corner panels (front corner panels)
26, 28 second corner panels (rear corner panels)
30-44 crease lines
46-52 slots
60 folding station
62 corner panel folding element
64 rod
66 rod
68 rod
70 box
72 lid
74 top panel
76 flap
78 crease line
80 box
82 sidewall
84 lid holding unit
86 suction cup
88 side panel
90 active pushing element
92 stamp
92 corner panel
94 rod
96 force arrow
98 corner panel
100 passive pushing element
102 spring steel strip
104 box entry unit
106 lid application unit
108 structure for moving the lid application unit
110 lid entry unit
112 glue application unit
114 lid application position
116 box exit unit
120 cardboard
122 stack of zig-zag folded cardboard
124 cutting and creasing station
126 receiving unit
128 item
130 item
132 item
134 laser scanning unit
136 folding station
138 gripping and folding unit
138 movement arrow
140 gripping and folding unit
142 glue application unit
144 lid placing station
146 folding unit
148 folding unit
150 glue application unit
152 box
154 box
156 label printing and application unit
160 cutting and creasing station
162 stack of cardboard
164 cardboard
166 glue application unit
168 glue application unit
170 glue application unit
172 lid
200 lid flap folding and pushing element
202 lid flap folding and pushing element

204 suction cup
206 suction cup
210 box creating station
212 order feed unit
214 blank creating unit
216 box folding unit
218 cardboard feed unit
220 lid forming station
222 lid blank creation unit
224 lid application station.
$H_{CP}$ height corner panel
$H_{EP}$ height end panel
$H_{SP}$ height side panel
$L_{BP}$ length bottom panel
$L_{CP}$ length corner panel
$L_{SP}$ length side panels
$W_{BP}$ width bottom panel
$W_{EP}$ width end panel

The invention claimed is:

1. A method for automatically closing an open packaging box with a cardboard lid, said box comprising a polygonal bottom panel defined by three or more bottom panel edges and sidewalls joined over respective crease lines to said bottom panel edges, each sidewall forming a substantially right angle with the bottom panel, said lid comprising a polygonal top panel defined by three or more top panel edges and corresponding to the bottom panel of the box to be closed and flaps joined over respective crease lines to said top panel edges and adapted for being folded onto a corresponding one of said sidewalls, the method comprising:

partially folding each flap along the respective crease line towards a position, in which the flap forms a substantially right angle with said top panel and placing the lid above said box such that the top panel and the bottom panel are substantially aligned and such that each flap overlaps a respective one of the sidewalls, releasing the lid allowing the lid to be guided by the partially folded flaps into a position on the box, in which the top panel and the bottom panel are aligned, and further folding each flap onto the respective sidewall fully into said position, in which the flap forms a substantially right angle with the top panel.

2. The method according to claim 1, wherein, in partially folding said flaps, the flaps are folded to form an angle of 120° to 150° with the top panel.

3. The method according to claim 1, wherein, in said releasing the lid, the lid is placed 5 to 50 mm, above the box and released to be guided by the partially folded flaps onto the box.

4. The method according to claim 1, wherein, in said releasing the lid, the lid is released above the box allowing it to fall by gravity onto the box while the partially folded flaps guide the lids onto the box.

5. The method according to claim 1, wherein elastic suction cups are used to place the lid above the box, which suction cups contract when a vacuum is applied to them for gripping the lid, wherein in said releasing the lid the elastic cups expand and push the lid towards the box.

6. A method for automatically closing an open packaging box with a cardboard lid, said box comprising a polygonal bottom panel defined by three or more bottom panel edges and sidewalls joined over respective crease lines to said bottom panel edges, each sidewall forming a substantially right angle with the bottom panel, said lid comprising a polygonal top panel defined by three or more top panel edges corresponding to the bottom panel of the box to be closed and flaps joined over respective crease lines to said top panel edges and adapted for being folded onto a corresponding one of said sidewalls, the method comprising:

partially folding each flap along the respective crease line towards a position, in which the flap forms a substantially right angle with said top panel and placing the lid on said box such that the top panel and the bottom panel are substantially aligned and such that each flap overlaps a respective one of the sidewalls, pushing the top panel slightly into the box to force the sidewalls outward against the flaps and further folding each flap onto the respective sidewall fully into said position, in which the flap forms a substantially right angle with the top panel.

7. The method of claim 6, wherein the top panel is simultaneously pushed towards the box in regions around the middle of each top panel edge.

8. The method according to claim 6, further comprising applying glue to the flaps or the side walls or both prior to folding the flaps onto the side walls.

9. The method according to claim 6, wherein, in partially folding said flaps, the flaps are folded to form an angle of 120° to 150° with the top panel.

10. The method according to claim 6, wherein, in said releasing the lid, the lid is released above the box allowing it to fall by gravity onto the box while the partially folded flaps guide the lids onto the box.

11. A system to automatically close an open packaging box with a cardboard lid, said box comprising a polygonal bottom panel defined by three or more bottom panel edges and side walls joint over respective crease lines to said bottom panel edges, each side wall forming a substantially right angle with the bottom panel, wherein a cardboard blank for said lid comprises a polygonal top panel defined by three or more top panel edges and corresponding to the bottom panel of the box to be closed and flaps joint over respective crease lines to said top panel edges and adapted to be folded onto a corresponding one of said side walls, the system comprising a lid placement station, the lid placement station comprising lid holders operable to grip said cardboard blank and lid folders operable to fold each flap partially along the respective crease line towards a position, in which the flap forms a substantially right angle with said top panel, said lid placement station which:

transports the lid into a position of the lid above said box such that the top panel and the bottom panel are substantially aligned and such that, when folded, each flap overlaps a respective one of the side walls, in which position the lid holders releases the lid allowing the lid to be guided by the partially folded flaps into a position, in which the top panel edges and the bottom panel are aligned, and wherein the lid folders then fold each flap onto the respective side wall fully into said position, in which the flap forms a substantially right angle with the top panel.

12. The system according to claim 11, wherein said lid holders of the lid placement station comprise elastic suction cups for gripping the lids.

13. A system to automatically close an open packaging box with a cardboard lid, said box comprising a polygonal bottom panel defined by three or more bottom panel edges and side walls joint over respective crease lines to said bottom panel edges, each side wall forming a substantially right angle with the bottom panel wherein gripping a cardboard blank for said lid comprises a polygonal top panel defined by three or more top panel edges and corresponding to the bottom panel of the box to be closed and flaps joint over respective crease lines to said top panel edges and adapted for being folded onto a corresponding one of said side walls, the system comprising a lid placement station, the lid placement station comprising lid holder operable to hold said cardboard blank and lid folders operable to fold each flap partially along the respective crease line towards a position, in which the flap forms a substantially right angle with said top panel, said lid placement station which:

transports the lid into a position of the lid above said box such that the top panel and the bottom panel are substantially aligned and such that, when folded, each flap overlaps a respective one of the side walls, and places the lid on the box such that the top panel and the bottom panel are aligned and such that, seen onto each side wall, when folded each flap overlaps a respective one of the side walls the lid placement station further comprising pushers operable to push the top panel, when the lid is in said position, slightly into the box to force the side walls outward against the flaps and wherein the lid folders then fold each flap onto the respective side wall fully into said position, in which the flap forms a substantially right angle with the top panel.

14. A method for automatically packaging varying shipment sets in custom-sized cardboard boxes, comprising:

obtaining the overall length, width and height dimensions of a shipment set consisting of one or more item(s) to be packaged, calculating, based on said information, the layout of a cardboard box blank for a box comprising a polygonal bottom panel defined by three or more bottom edges and side walls joined over respective crease lines to said bottom panel edges, each side wall forming in the folded state a substantially right angle with the bottom panel, and calculating based on said information the layout of a cardboard lid layout for a lid comprising a polygonal top panel, the polygonal top panel defined by three or more top panel edges and corresponding to the bottom panel of the box to be closed and flaps joint over respective crease lines to said top panel edges and adapted for being folded onto a corresponding one of said side walls, cutting and creasing cardboard to form a cardboard box blank and a cardboard lid blank having the calculated layouts, conveying the shipment set onto the bottom panel prior or after folding a box out of said cardboard box blank, partially folding each flap along the respective crease line towards a position, in which the flap forms a substantially right angle with said top panel and placing the lid above said box such that the top panel and the bottom panel are substantially aligned and such that each flap overlaps one of the sidewalls, releasing the lid allowing it to be guided by the partially folded flaps into a position on the box, in which the top panel and the bottom panel are aligned, and folding each flap onto the respective sidewall fully into said position, in which the flap forms a substantially right angle with the top panel.

15. A method for automatically packaging varying shipment sets in custom-sized cardboard boxes, comprising:

obtaining the overall length, width and height dimensions of a shipment set consisting of one or more item(s) to be packaged, calculating, based on said information, the layout of a cardboard box blank for a box comprising a polygonal bottom panel defined by three or more bottom edges and side walls joined over respective crease lines to said bottom panel edges, each side wall forming in the folded state a substantially right angle with the bottom panel, and calculating based on said information the layout of a cardboard lid layout for a lid comprising a polygonal top panel, the polygonal top panel defined by three or more top panel edges and corresponding to the bottom panel of the box to be closed and flaps joint over respective crease lines to said top panel edges and adapted for being folded onto a corresponding one of said side walls, cutting and creasing cardboard to form a cardboard box blank and a cardboard lid blank having the calculated layouts, conveying the shipment set onto the bottom panel prior or after folding a box out of said cardboard box blank, partially folding each flap along the respective crease line towards a position, in which the flap forms a substantially right angle with said top panel and placing the lid above said box such that the top panel and the bottom panel are substantially aligned and such that each flap overlaps one of the sidewalls, pushing the top panel slightly into the box to force the sidewalls outward against the flaps, and folding each flap onto the respective sidewall fully into said position, in which the flap forms a substantially right angle with the top panel.

* * * * *